US005778541A

United States Patent [19]

McClung

[11] Patent Number: 5,778,541

[45] Date of Patent: Jul. 14, 1998

[54] PRO PUMPKIN CARVER

[76] Inventor: Robert K. McClung, 438 Greenlow Rd., Baltimore, Md. 21228

[21] Appl. No.: 829,501

[22] Filed: Mar. 28, 1997

[51] Int. Cl.[6] ..... B26B 7/00

[52] U.S. Cl. ..... 30/277.4; 30/272.1

[58] Field of Search ..... 30/277.4, 272.1, 30/340, 342, 392

[56] References Cited

U.S. PATENT DOCUMENTS

| | | | |
|---|---|---|---|
| 3,234,649 | 2/1966 | Preble et al. | 30/277.4 |
| 3,300,857 | 1/1967 | Rosen et al. | 30/277.4 |
| 3,300,858 | 1/1967 | Young | 30/277.4 |
| 3,322,925 | 5/1967 | Korshak | 30/277.4 |
| 3,337,952 | 8/1967 | Rosen | 30/277.4 |
| 3,339,282 | 9/1967 | Hansen | 30/277.4 |
| 3,388,470 | 6/1968 | Ufer | 30/277.4 |
| 3,650,029 | 3/1972 | Trelc | 30/277.4 |
| 3,688,139 | 8/1972 | Yaguchi | 30/388 |
| 4,674,154 | 6/1987 | Gilbert et al. | 30/277.4 |
| 4,689,885 | 9/1987 | Albanese | 30/277.4 |
| 4,711,030 | 12/1987 | Ruston, Sr. | 30/277.4 |
| 5,058,273 | 10/1991 | Steger | 30/277.4 |

*Primary Examiner*—Hwei-Siu Payer

*Attorney, Agent, or Firm*—Patent & Trademark Services; Joseph H. McGlynn

[57] ABSTRACT

An electric powered handle which will receive different sizes and shapes of blades which can be used to carve pumpkins. In addition, the handle has a safety interlock to prevent operation unless the blade is completely locked into the handle.

7 Claims, 1 Drawing Sheet

PRO PUMPKIN CARVER

BACKGROUND OF THE INVENTION

This invention relates, in general, to carving knives, and, in particular, to an electrical carving knife for carving pumpkins.

1. Description of the Prior Art

In the prior art various types of carving knives have been proposed. For example, U.S. Pat. No. 3,388,470 discloses a power knife in which two blades are arranged in side-by-side relationship and reciprocate in order to cut.

U.S. Pat. No. 4,674,154 discloses an electric oyster knife in which a blade is mounted in a holder which is mounted in a case and in which an electromagnet oscillates the blade holder. U.S. Pat. No. 4,689,885 discloses a hand tool for carving pumpkins which has a plurality of carving blades.

U.S. Pat. No. 4,711,030 discloses a portable hand held electric carving knife which draws its power from a remote storage battery.

U.S. Pat. No. 5,058,273 discloses a carving tool having a vibratory motor to effect vibratory energy to a shaft projection.

SUMMARY OF THE INVENTION

The present invention comprises an electric powered handle which will receive different sizes and shapes of blades which can be used to carve pumpkins. In addition, the handle has a safety interlock to prevent operation unless the blade is completely locked into the handle.

It is an object of the present invention to provide a new and improved pumpkin carver.

It is an object of the present invention to provide a new and improved pumpkin carver which is electrically powered.

It is an object of the present invention to provide a new and improved pumpkin carver which is safe to operate.

These and other objects and advantages of the present invention will be fully apparent from the following description, when taken in connection with the annexed drawings.

DESCRIPTION OF THE PREFERRED EMBODIMENT

Figure 1:
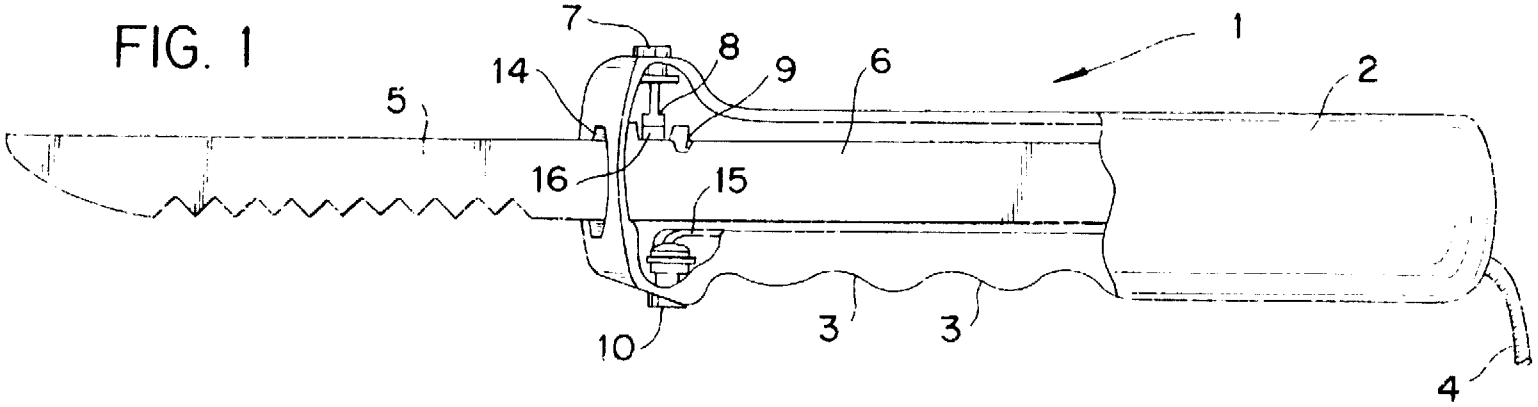
FIG. 1 is a partial cut-away side view of the present invention.

Referring now to the drawings in greater detail, FIG. 1 shows an electric powered knife 1 which has an electric cord 4 extending from the rear of the handle 2 which can be attached to an electric outlet by means of a standard electric plug (not shown). Inside the handle 2 of the knife is a conventional motor (not shown) which will move the blades 5, 11, 12 or 13 in order to cut a pumpkin or some other item.

Each of the blades will have a shaft 6 integrally or unitarily connected thereto. The shaft will be of a size to enter a slot 14 in the front of the handle 2. Each shaft 6 will have a cutout or groove 9 which will receive a plunger 8. The plunger 8 will be the type used to extend and retract ball point pens or a push-push switch. That is the type that if pushed once will extend the plunger 8 into the groove 9 on the knife shaft, and if pushed again, will retract the plunger 8 from the groove 9 on the knife shaft. The plunger 8 will be connected to a push button 7 which extends through the top of the handle 2. When the push button 7 is depressed a second time it will retract the plunger 8 so the blade shaft 6 can be removed from the handle for cleaning or to be replaced with a different blade.

Figure 5:
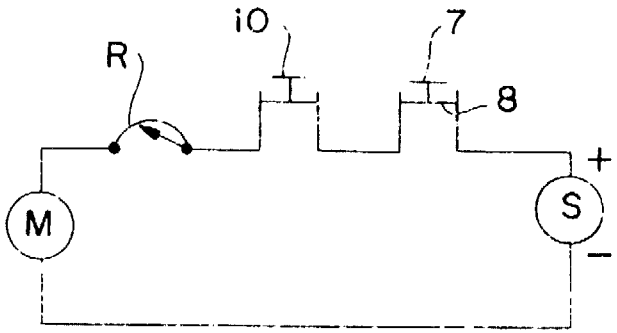
FIG. 5 is a schematic of the electric circuit of the present invention.

The plunger 8 also acts as a safety feature, as shown by the electrical diagram in FIG. 5. As long as the plunger 8 and the push button 7 are not depressed, the circuit, supplying power from the source of electricity S, will be open and electricity will not be supplied to the motor M. This will prevent someone from being injured if the blade shank 6 is not fully seated in the knife handle 2. If the shank is not pushed fully into the handle, the plunger 8 will not be able to enter the groove 9 on the shank of the knife, and the circuit will not be complete. This will prevent someone from not having the knife shank locked into the handle by means of the plunger 8 and the groove 9. If the knife were not locked into the handle and electricity were supplied to the motor, the knife could be propelled out of the handle, thereby causing injury. Also, the tip 16 of the plunger should be made from an insulating material so electricity will not pass through the knife blade.

On the bottom of the knife handle 2 is a push button 10 which will be connected by means of electrical wires 15 to the motor in the handle of the knife. Connected between the push button 10 and the source of electrical power supplied to the motor will be a motor speed control such as, but not limited to, a rheostat R (see FIG. 5). The further the button 10 is pushed in, the more electrical power is supplied to the motor M and the faster the knife will operate. Obviously, the push button 10 is not the only type of control that can be used to control the rheostat R. Any conventional rheostat control such as, but not limited to, a rotatable knob could also be used.

The bottom of the knife handle 2 also has depressions 3 so the handle can be held comfortably by a user's hand.

Figure 4:
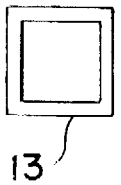
FIGS. 2–4 are end views of the cutting blades used with the present invention.
Figure 3:
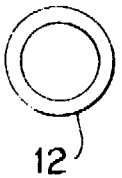
Figure 2:
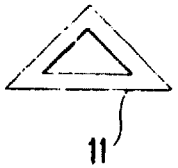

FIGS. 2–4 show some of the different types of cutting blades, in addition to the blade 5, that can be used with the handle. The blade 11 is triangular, the blade 12 is circular, and the blade 13 is rectangular. These shapes will make it easy to cut traditional shapes into a pumpkin such as the eyes, nose and mouth. The forward portion of each of the blades 11–13 will have sharpened edges to make it easier for the various blades to penetrate the pumpkin or other object to be cut.

In use, a user would select a blade to be used and pass the shank through the aperture 14 in the front of the knife handle 2. It would be pushed as far into the handle as possible and then the button 7 will be pushed once. This will force plunger 8 into the groove or depression 9 in the shank 6 of the knife, locking the blade into the handle and completing the electrical circuit.

The button or knob 10 will be depressed supplying power to the motor which will move the knife 5, 11, 12, or 13 back and forth. The further the button 10 is pressed, the more electrical power is supplied through the rheostat R, and the faster the blade will go. The user can select whichever blade he/she needs to perform the necessary cuts, and the job will be performed easier since the user is not doing the job manually.

Although the Pro Pumpkin Carver and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A power knife comprising:

a handle having a knife blade accepting opening at one end and means for connecting said handle to a source of electrical power at another end, motor means associated with said handle for powering said power knife, a knife blade mounted in said handle, said knife blade having a cutting surface on one end and a shank on an opposite end, said handle having locking means for securing said shank within said handle and for interrupting electrical power to said motor, said locking means being movable from a first position, in which said locking means does not secure said shank in said handle and in which no electrical power is supplied to said motor, to a second position in which said locking means secures said shank in said handle and in which electrical power is supplied to said motor, and wherein said locking means for securing said shank within said handle and for interrupting electrical power to said motor is a push button which operates a plunger attached thereto, said shank has a groove, and said plunger enters said groove when said knife blade is locked within said handle.

2. The power knife as claimed in claim 1, wherein said handle also has switch means for controlling the speed of said motor.

3. The power knife as claimed in claim 2, wherein said switch means for controlling the speed of said motor comprises a rheostat.

4. The power knife as claimed in claim 1, wherein said cutting surface is a serrated surface on one edge of said knife blade.

5. The power knife as claimed in claim 1, wherein said cutting surface is triangular in cross-section.

6. The power knife as claimed in claim 1, wherein said cutting surface is circular in cross-section.

7. The power knife as claimed in claim 1, wherein said cutting surface is rectangular in cross-section.

* * * * *